US006959155B2

(12) United States Patent
Kim

(10) Patent No.: US 6,959,155 B2
(45) Date of Patent: Oct. 25, 2005

(54) SYSTEM AND METHOD FOR JUDGING PAPER-JAM CONDITIONS OF AN IMAGE FORMING APPARATUS

(75) Inventor: Jun-won Kim, Seongnam (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/773,285

(22) Filed: Feb. 9, 2004

(65) Prior Publication Data

US 2005/0002678 A1 Jan. 6, 2005

(30) Foreign Application Priority Data

Jul. 1, 2003 (KR) ..... 10-2003-0044168

(51) Int. Cl.[7] ..... G03G 15/00

(52) U.S. Cl. ..... 399/21; 399/16; 217/258.01; 217/3.16

(58) Field of Search ..... 399/16–21, 385, 399/389; 271/258.01, 258.03, 3.16–3.17, 4.02–4.03, 10.02–10.03, 110, 265.01, 265.02, 259; 400/605, 708

(56) References Cited

U.S. PATENT DOCUMENTS 5,563,686 A * 10/1996 Beaufort et al. ..... 399/13
5,580,046 A * 12/1996 Beaufort et al. ..... 271/3.16
5,615,876 A * 4/1997 Yergenson et al. ..... 271/258.01
5,678,123 A * 10/1997 Kim ..... 399/21
6,782,214 B2 * 8/2004 Hoberock et al. ..... 399/21

* cited by examiner

*Primary Examiner*—Minh Chau
(74) *Attorney, Agent, or Firm*—Roylance, Abrams, Berdo & Goodman, L.L.P.

(57) ABSTRACT

A system and method for judging a paper jam condition in a device, such as an image forming apparatus, including the steps of checking a feed sensor unit, operating a timer, and if it is judged that the feed sensor unit is switched to an "ON" state, calculating a value $T_1$ for a fuse lamp drive unit of the apparatus to be in an "ON" state. The system and method then directs a comparison of the value $T_1$ with a reference value $T_2$, and judges a paper jam condition exists and aborts a printing operation if the value $T_1$ is out of an error range of the $T_2$. The paper jam condition is detected through the use of a feed sensor unit and monitoring of the fuser control, therefore a discharge sensor unit is not required at a discharging side of the image forming apparatus for sensing the paper jam condition.

20 Claims, 7 Drawing Sheets

< FUSER ON WAVE FORM AT NORMAL PRINTING OPERATION >

< FUSER ON WAVE FORM WHEN PRINTING PAPER DOES NOT ENTER FUSER >

SYSTEM AND METHOD FOR JUDGING PAPER-JAM CONDITIONS OF AN IMAGE FORMING APPARATUS

CROSS-REFERENCE TO RELATED APPLICATIONS

This application claims the benefit of Korean Patent Application No. 2003-44168, filed Jul. 1, 2003, in the Korean Intellectual Property Office, the disclosure of which is incorporated herein by reference.

BACKGROUND OF THE INVENTION

1. Field of the Invention

The present invention relates to a system and method for judging a paper-jam condition in a device such as an image forming apparatus, and more specifically, to a method for judging a paper-jam condition in an image forming apparatus without using a mechanical element such as an actuator and an optical sensor on a discharging side of the apparatus.

2. Description of the Related Art

Generally, an image forming apparatus such as a copier, a printer, and a facsimile, develops an electrostatic latent image which is formed on a photoconductive drum by a laser beam scan of a laser scanning unit (LSU), with a toner to form a visible image. The apparatus then transfers the visible image onto a printing paper and prints an expected image. The image forming apparatus can also judge a paper jam condition when the printing paper is not delivered normally within a system. If so, the image forming apparatus aborts the printing operation so as to allow removal of the paper jam.

FIG. 1 is a view in partial cross section showing a conventional electrophotographic image forming apparatus, and FIG. 2 is a view in partial cross section showing a sensor unit used in the image forming apparatus of FIG. 1. FIG. 3 is a flowchart showing a method for checking the paper jam condition of the image forming apparatus of FIG. 1.

As shown in FIG. 1, to judge the paper jam condition, the image forming apparatus comprises a pickup sensor unit 10 disposed at an upper portion of a paper cassette 1, a feed sensor unit 20 disposed between a photoconductive drum 3 and a fuser 50, and a discharge sensor unit 30 disposed between the fuser 50 and the discharge.

As describe in the flow chart of FIG. 3, the pickup sensor unit 10, which is disposed at the upper portion of the paper cassette 1, judges whether the printing papers are stacked up or not at step S10. In receiving a print order to a printing system, if the pickup sensor unit 10 is in an "ON" state, which means the printing papers are stacked up, a printing mode is continued at step S20. If the pickup sensor unit 10 is in an "OFF" state, meaning that the printing papers are not stacked up, the printing mode is aborted and a user is notified that there is no printing paper at step S50.

In the example where the pickup sensor unit 10 is in the "ON" state, the printing paper is delivered toward an image forming unit, such as through a transfer nip between the photoconductive drum 3 and a transfer roller 7. On the delivered printing paper, a toner image is formed by processes that are well known to those skilled in the art, such as charging, laser beam scanning, developing and transferring. The printing paper is then delivered toward the fuser 50 by a rotatory force of a feeding roller.

At this time, when a leading edge of the printing paper passes the feed sensor unit 20, the feed sensor unit 20 is switched to an "ON" state, and after a predetermined time, if the rear edge of the printing paper safely passes the feed sensor unit 20, the feed sensor unit 20 is switched to an "OFF" state. As the printing paper is delivered toward the fuser 50, the toner image is fixed on the printing paper by a heating roller 50*a* and a pressure roller 50*b*. The printing paper on which the toner image is fixed is finally discharged from of the image forming apparatus by a discharge roller 9. Reference numeral 11 indicates a feeding roller, 13 indicates a developing roller and P indicates the printing paper included in FIG. 1.

Returning to FIG. 3, if the feed sensor unit 20 does not switch to the "ON" state after a predetermined time, or is not switched to the "OFF" state after a predetermined time, a control unit judges that the printing paper was delivered abnormally at step S30. Accordingly, the control unit aborts the printing operation and notifies the user of the occurrence of the paper jam at step S60.

If the leading edge of the printing paper, which passed through the fuser 50, then passes the discharge sensor unit 30, the discharge sensor unit 30 is switched to an "ON" state. After a predetermined time, if the rear edge of the printing paper passes the discharge sensor unit 30 and the printing operation is proceeding normally, the discharge sensor unit 30 is switched to an "OFF" state. If the discharge sensor unit 30 does not switch to the "ON" state after a predetermined time, or does not switch to the "OFF" state from the "ON" state after a predetermined time at step S40, it is judged that the printing paper was delivered abnormally and the printing operation is aborted and the user is notified of the occurrence of the paper jam at step S70.

A well-known actuator and a photo interrupter can be used for the feed sensor unit 20 and the discharge sensor unit 30 in FIG. 1. FIG. 2 shows an actuator/interrupter component including an actuator 31 and an optical sensor 33 commonly used for such a feed sensor unit 20 and the discharge sensor unit 30, which will be described in greater detail below.

The actuators 31 of the discharge sensor unit 30 are rotated by the leading edge of the delivered printing paper P. Hence, a phototransistor of the optical sensor 33 receives a light transmitted from a light emitting diode and a sensing signal is generated. Then, the discharge sensor unit 30 is switched to the "ON" state and the control unit detects ingress of the printing paper based on the sensing signal received from the discharge sensor unit 30. After the printing paper passes the actuators 31, the actuators 31 rotate to their initial positions so that the light received to the phototransistor of the optical sensor 33 is blocked off. Therefore, the sensing signal is not generated so that the discharge sensor unit 30 is switched to the "OFF" state and the control unit detects that the printing paper has normally passed through based on the sensing signal received from the discharge sensor unit 30. Though an operation of the feed sensor unit 20 has not been described, interaction of an actuator and an optical sensor of the feed sensor unit 20 thereof is identical with that of the discharge sensor unit 30.

However, in the method for judging the paper jam of the conventional image forming apparatus as described above, the actuator 31 and the optical sensor 33 have to be equipped on a discharging side of the image forming apparatus. Accordingly, the paper jam may be caused by problems of the apparatus, such as an inferior assembly of the actuator 31 and shaping of unit parts. Further, other parts or circuits cannot be installed within an operational range of the actuator 31 due to spatial constraints. In addition, owing to an inferior assembly of the optical sensor 33, the sensing operation may not be performed normally, and owing to a ripple or bounce in the operation of the actuator 31, accurate signal data may not be generated.

Accordingly a need exists for a system and method to judge a paper jam condition in an image forming apparatus without requiring a mechanical element such as an actuator and an optical sensor on a discharging side of the apparatus which are subject to assembly and operational malfunctions.

SUMMARY OF THE INVENTION

Accordingly, an object of the present invention is to solve the above disadvantages by providing a system and method for judging a paper jam condition of an image forming apparatus by sensing both a normal and abnormal ingress and discharge of a printing paper without having to use an actuator or an optical sensor at a discharging side of the apparatus.

Another object of the present invention is to provide a system and method for a first timer to monitor a fuse lamp drive unit, and a second timer to provide a reference time value for use in a comparison with the first timer to determine if a normal ingress and discharge of a printing paper has occurred.

Another object of the present invention is to provide a system and method for a controller for use in controlling a fuser temperature at a desired level.

These and other objects are substantially achieved by providing a system and method for judging the paper jam of the image forming apparatus through implementing the steps comprised of (a) checking a feed sensor unit, (b) operating a timer, and if it is judged that the feed sensor unit is switched to an "ON" state in the step (a) indicating that a leading paper edge has passed, then (c) calculating a time value $T_1$ for a fuse lamp drive unit to be in an "ON" state, (d) comparing the value $T_1$ with a reference value $T_2$, and (e) judging the "paper jam" and aborting a printing operation if the value $T_1$ is out of an error range of the value $T_2$ according to the comparison result of the step (d).

According to the comparison result of the step (d), if the value $T_1$ is within the error range of the value $T_2$ and the feed sensor unit is switched to an "OFF" state after a predetermined time indicating a rear edge of the paper has passed, the printing operation is proceeded with as normal.

According to an embodiment of the present invention, one example of an error range is ±10% of the value $T_2$ The value $T_2$ is a function of the rate of heat exchanged between the fuser and the passing paper.

The step (e) further comprises the step of displaying the paper jam state on a display.

The value $T_2$ is an average value of a time for the fuse lamp drive unit to be in the "ON" state in cases where the printing paper is normally delivered to a fuser, that is, an expected fuse lamp drive unit "ON" time in a normal operation. When the feed sensor unit is switched "ON" indicating that a leading paper edge has passed, the expected time $T_2$ is compared with $T_1$, which is the measured actual "ON" time of the fuse lamp drive unit. If $T_1$ is outside an error range, the "ON" time for the fuse lamp drive unit is too long or to short, and the system and method judges a paper jam. Likewise if the feed sensor unit is never switched to an "OFF" state indicating a rear edge of the paper never passed, the system and method judges a paper jam. If the value $T_1$ is within the error range of the value $T_2$ indicating the "ON" time for the fuse lamp drive unit is normal, and the feed sensor unit is switched to an "OFF" state after a predetermined time indicating the rear edge of the paper has passed, the printing operation is considered normal.

In yet a second embodiment of the present invention, a system and method for judging a paper jam of an image forming apparatus can be achieved through implementing the steps comprised of (a) checking a pickup sensor unit, (b) checking a feed sensor unit, and if it is judged that the pickup sensor unit is switched to an "ON" state in the step (a), then (c) operating a timer, and if it is judged that the feed sensor unit is switched to the "ON" state in the step (b) indicating the leading edge of the paper has passed, then (d) calculating a time $T_1$ for a fuse lamp drive unit to be in an "ON" state, (e) comparing the value of $T_1$ with a reference value $T_2$, and (f) judging the "paper jam" and aborting a printing operation if the value $T_1$ is out of an error range of the value $T_2$ according to the comparison result of the step (e).

If the pickup sensor unit is judged to be switched to an "OFF" state in the step (a), the system and method implements the step of judging "no printing paper" and aborting the printing operation.

If the feed sensor unit is judged to be switched to an "OFF" state after a predetermined time in the step (b) indicating the rear edge of the paper has passed, yet the value $T_1$ is out of an error range of the value $T_2$ which indicates the paper failed to reach the fuser, the system and method implements the step of judging the "paper jam" and aborting the printing operation. The feed sensor unit would be switched to an "OFF" state as the rear edge of a paper passed, and a comparison of between $T_1$ and $T_2$ should show the paper then reaching the fuser. If not, the system and method judges a paper jam.

According to the comparison of the step (e), if the value $T_1$ is within the error range of the reference value $T_2$ and if the feed sensor unit is switched to an "OFF" state after a predetermined time indicating the rear edge of the paper has passed, the printing operation is proceeded with as normal.

As with the first embodiment, one example of an error range which can be used is an error range that is within ±10% of the value $T_2$.

The step (f) further comprises the step of displaying the paper jam state on a display.

The value $T_2$ is an average value of a time for the fuse lamp drive unit to be in the "ON" state in cases where the printing paper is normally delivered to a fuser.

As aforementioned, according to the embodiments of the present invention described in greater detail below, a discharge sensor unit having an actuator and an optical sensor is not required to be equipped at a discharging side of the image forming apparatus for sensing the paper jam state, and thereby reduces an overall manufacturing cost.

In addition, a compact sized image forming apparatus can be provided since space is not limited by a required movement of the actuator at the discharge side.

Also, misjudgment on the paper jam condition caused by generation of inaccurate signal data due to an inferior unit part of the optical sensor and/or a ripple of the actuator is prevented.

BRIEF DESCRIPTION OF THE DRAWINGS

The above aspects, and other features and advantages of the present invention will become more apparent after a reading of the following detailed description when taken in conjunction with the drawings, in which.

DETAILED DESCRIPTION OF THE PREFERRED EMBODIMENTS

Hereinafter, an embodiment of the present invention will be described in detail with reference to the accompanying drawings.

Figure 1:
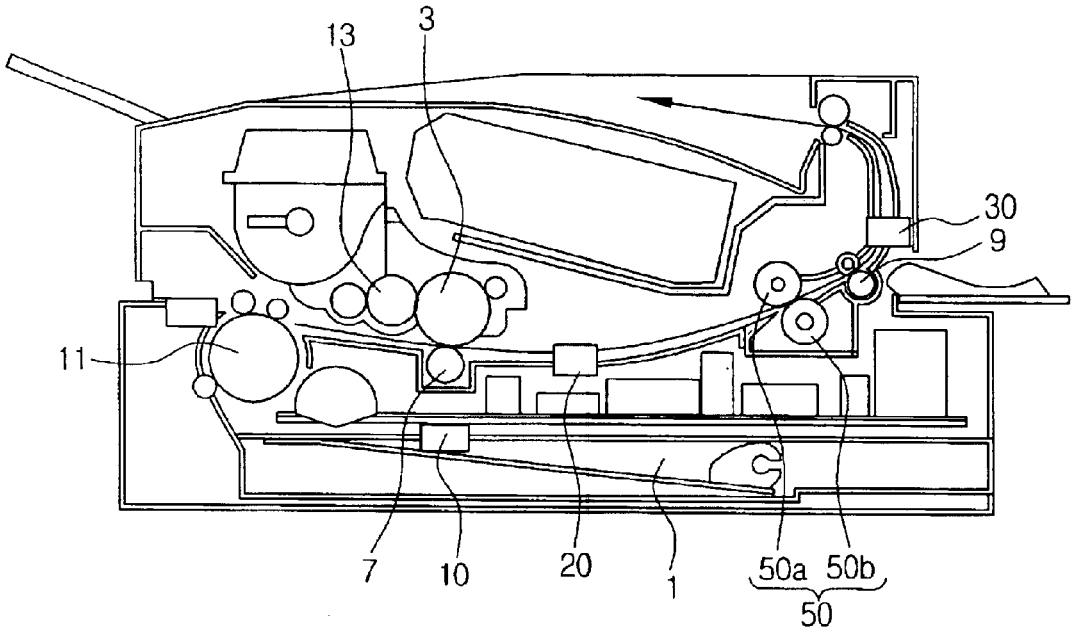
FIG. 1 (PRIOR ART)
FIG. 1 is a view in partial cross section showing an example of a conventional image forming apparatus.

As described in regards to the prior art device of FIG. 1, an image forming apparatus can form an expected image through several processes well known to those skilled in the art, including charging, laser beam scanning, transferring, and fixing. The fixing process is provided to fix a toner transferred on a printing paper by the heat of a heating roller 50*a* and the pressure of a pressure roller 50*b* in a fuser 50. The heat of the heating roller 50*a* is irradiated from a fuse lamp (not shown) disposed in the heating roller 50*a*. Accordingly, a fuse temperature is determined by the degree of heat from the fuse lamp 51.

In an example where there is a printing paper jam in the fuser 50, a fire may break out if the fuser temperature is too high. However, if the fuse temperature is too low, the toner may not be fixed on the printing paper properly. Accordingly, the fuser 50 is controlled to maintain an appropriate temperature.

Figure 4:
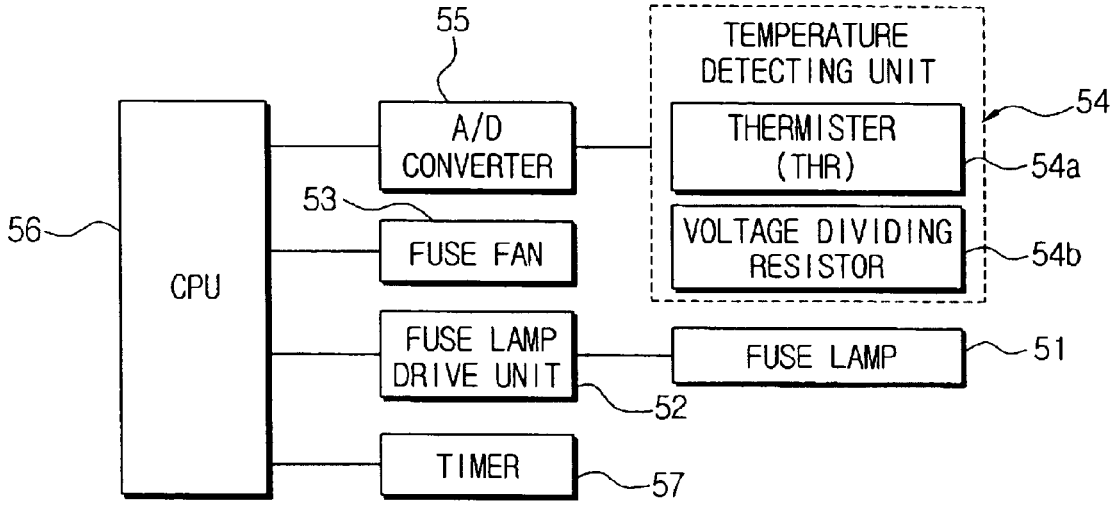
FIG. 4 is a block diagram schematically showing an example of a control system for adjusting a temperature of a fuser in accordance with an embodiment of the present invention.

FIG. 4 is a block diagram showing an example of a control system for use with the image forming apparatus for controlling the temperature of the fuser 50 in accordance with an embodiment of the present invention. As shown in FIG. 4, the system comprises the fuse lamp 51 as a heat generator for fixing, a fuse lamp drive unit 52 for driving the fuse lamp 51, a fuse fan 53 for regulating the fuse temperature, and a temperature detecting unit 54 for generating a detected voltage signal according to the temperature change. The temperature detecting unit 54 has a thermister (THR) 54*a* disposed in tight contact with the heating roller 50*a* to detect the fuse temperature and a voltage dividing resistor 54*b*. The system further comprises an analog-to-digital (A/D) converter 55 for converting the detected voltage signal to a digital data signal, and a CPU 56 for controlling the "ON/OFF" state of the fuse fan 53 and the fuse lamp driving unit 52 by comparing the converted digital data signal with a predetermined value.

A controlling operation of the fuse temperature is described in greater detail below. First, the fuse temperature of the fuser 50 is detected by the THR 54*a* which provides a negative resistance with respect to the temperature. If the fuse temperature of the fuser 50 changes, a resistance value of the THR 54*a* also changes. Accordingly, a power voltage that is applied to the detecting unit 54 is divided by the THR 54*a* and the voltage dividing resistor 54*b* to thereby provide the detected voltage signal. The detected voltage signal is input to the A/D converter 55, and the A/D converter 55 converts the detected voltage signal input into the digital data signal.

Next, the CPU 56 compares the converted digital data signal with a predetermined value, and then adjusts and maintains the fuse temperature at a substantially optimum degree. For example, if the fuse temperature of the heating roller 50*a* is lower than the optimum temperature, the detected voltage signal is lower than a voltage reference. At this time, in order to raise the fuse temperature, the CPU 56 controls the fuse lamp drive unit 52 to be switched to the "ON" state so that the fuse lamp 51 can radiate heat. In addition, if the fuse temperature of the heating roller 50*a* is higher than the optimum temperature, the detected voltage signal is higher than a voltage reference. In order to reduce the fuse temperature, the CPU 56 controls the fuse lamp drive unit 52 to switch to the "OFF" state, which cuts off power to the fuse lamp 51 and operates the fuse fan 53. If the fuse temperature of the heating roller 50*a* is at the optimum temperature (i.e., if the detected voltage is substantially equal to the voltage reference), the CPU 56 controls the fuse lamp 51 and the fuse fan 53 to remain in their current states. Accordingly, the fuse temperature is adjusted to an optimum value.

Referring to graphs of FIGS. 5A and 5B, an example feature operation of the fuser 50 having the above temperature control unit is described in greater detail below.

Figure 5A:
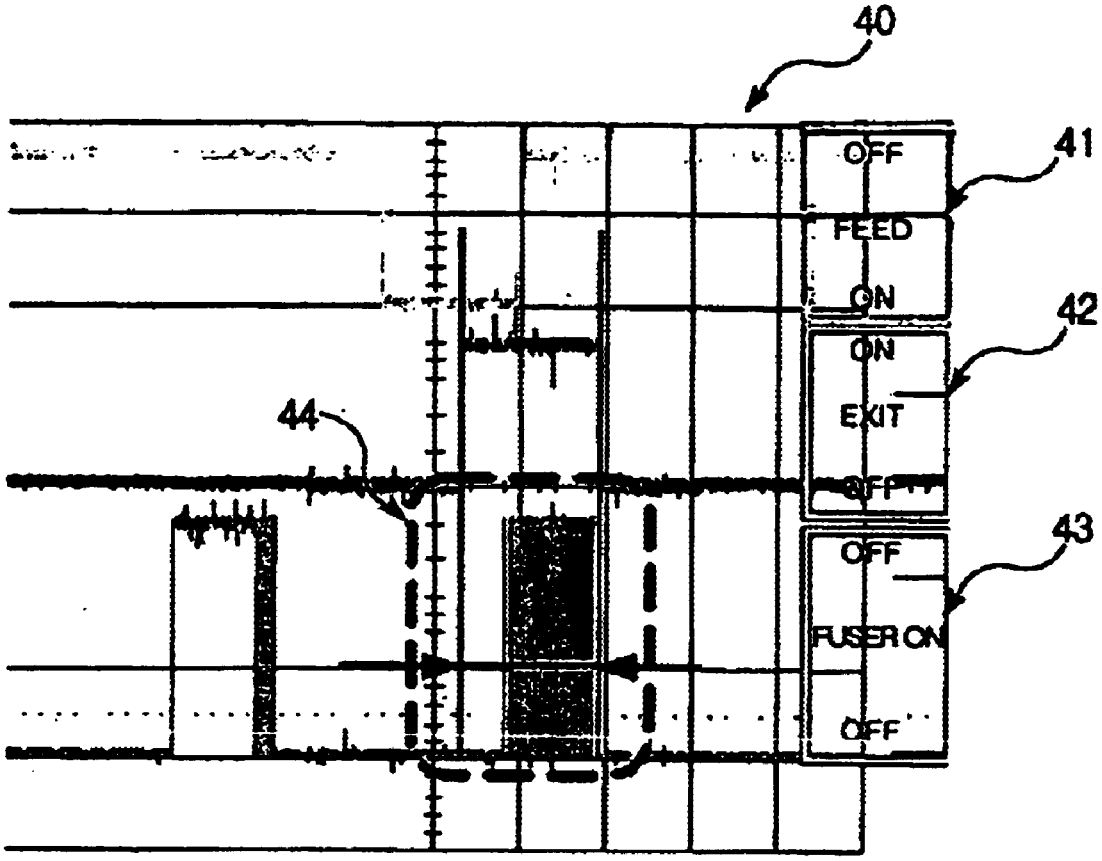
FIGS. 5A and 5B are views illustrating an example of the features of the control system of the FIG. 4.

FIG. 5A shows the feature operation in an example where the printing paper is delivered normally into the fuser 50. The plot 40 illustrates a feed sensor ON/OFF signal 41, an exit sensor ON/OFF signal 42 and a fuser ON/OFF control signal 43 waveform. When the printing paper is delivered into the fuser 50, the heat of the heating roller 50*a* is transferred to the printing paper so that the temperature of the heating roller 50*a* falls. The CPU 56 controls the fuse lamp drive unit 52 of the fuser 50 to be switched to an "ON" state as shown in the bounded area 44 of waveform 43 so that the temperature of the fuser 50 can rise. If the temperature is maintained at an optimum degree after a predetermined time, the fuse lamp drive unit 52 of the fuser 50 is then switched to an "OFF" state.

Figure 5B:
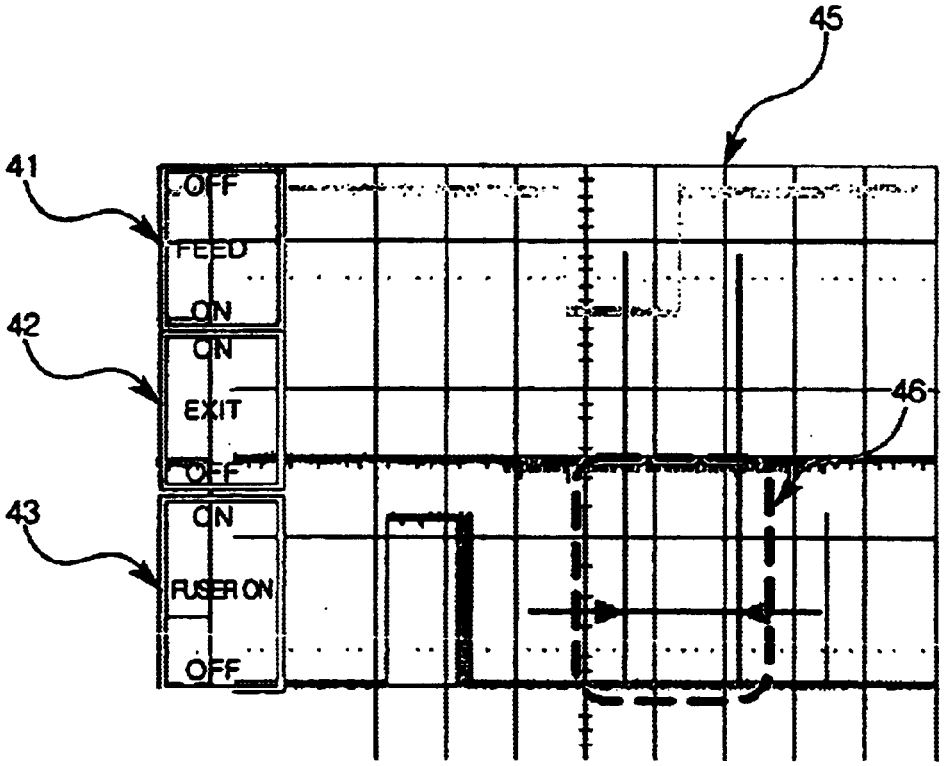

FIG. 5B shows the feature operation in an example where the printing paper is delivered abnormally into the fuser 50, in which a time of the "ON" state of the fuse lamp drive unit 52 is shortened. As above, the plot 45 illustrates a feed sensor ON/OFF signal 41, an exit sensor ON/OFF signal 42 and a fuser ON/OFF control signal 43 waveform. When the printing paper is not delivered into the fuser 50, the heat of the heating roller 50*a* is not transferred to the printing paper so that the temperature of the heating roller 50*a* does not fall as when paper is delivered. The CPU 56 controls the fuse lamp drive unit 52 of the fuser 50 to maintain a current state, or be switched to an "OFF" state, as shown in the bounded area 46 of waveform 43 so that the temperature of the fuser 50 will not rise. That is, as the printing paper is not delivered normally, there is little or no heat transferred to the printing paper and the temperature of the heating roller 50*a* is not significantly reduced. Hence, a time required for heating the fuse lamp 51 is lessened, and results in a shortened "ON" time for the fuse lamp drive unit 52.

Figure 6:
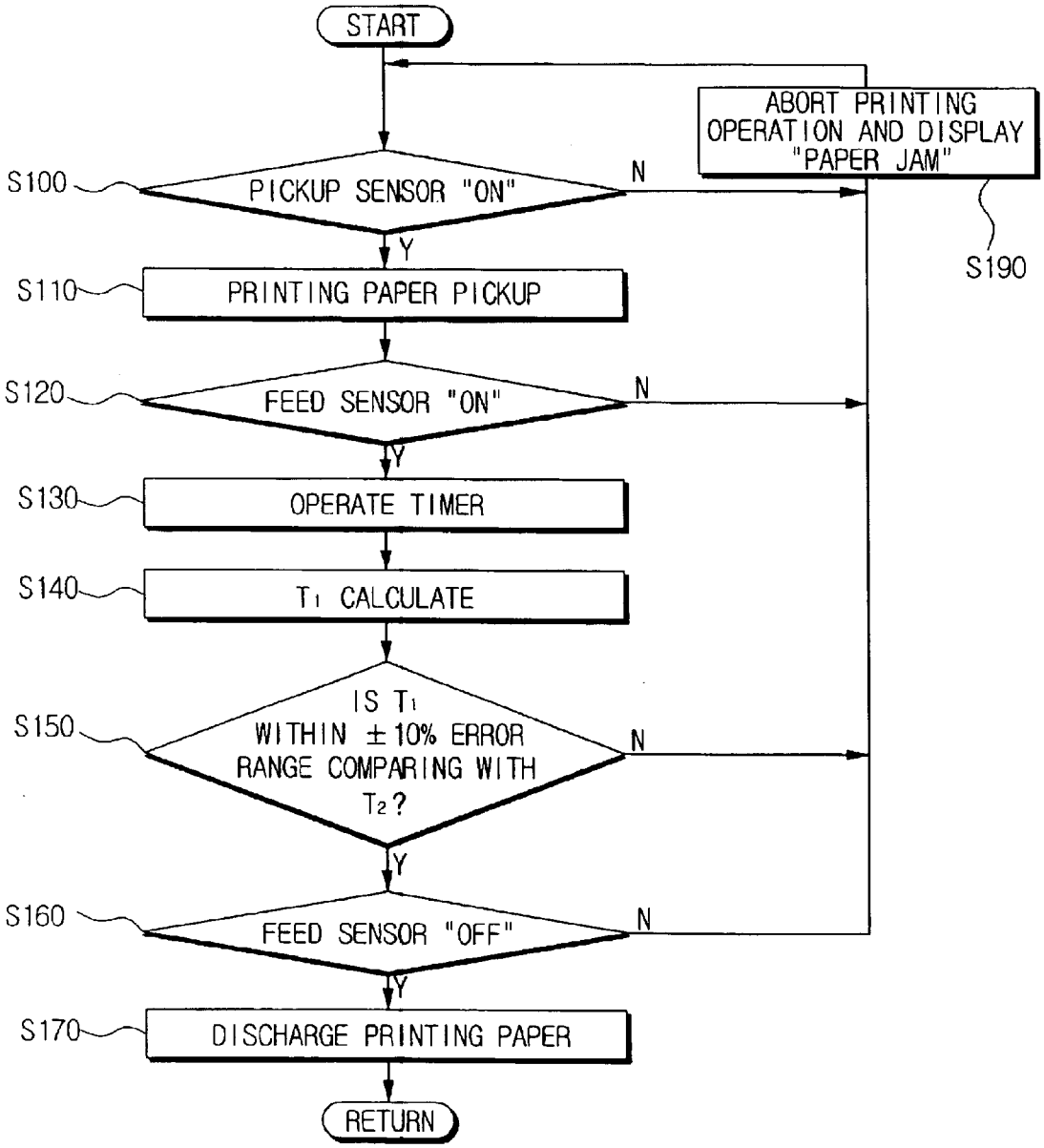
FIG. 6 is a flow chart showing a method for judging a paper jam condition of an image forming apparatus in accordance with an embodiment of the present invention.

The embodiment of the present invention described below includes a system and method for judging the paper jam condition of the image forming apparatus using the feature of controlling the fuse temperature of the fuser 50 as described above. Hereinafter, the embodiment of the present invention is described in greater detail with reference to FIGS. 1, 4 and 6. FIG. 6 is a flow chart showing a method for judging a paper jam condition of an image forming apparatus in accordance with an embodiment of the present invention.

The image forming apparatus includes a control system having a CPU 56 for controlling the "ON/OFF" state of the fuse fan 53 and the fuse lamp driving unit 52 by comparing the converted digital data signal with a predetermined value. As described in FIG. 6, upon receiving a printing order, the CPU 56 judges whether the printing papers are stacked up in a paper cassette 1 with a pickup sensor unit 10 at step S10. In the example where the pickup sensor unit 10 is in the "OFF" state, the CPU 56 judges that there is no printing paper and the CPU notifies a user that there is no printing paper at step S19. In the example where the pickup sensor unit 10 is in the "ON" state, the CPU 56 judges that there is printing paper and the printing paper is picked up and delivered toward an image forming unit at step S11.

Figure 2:
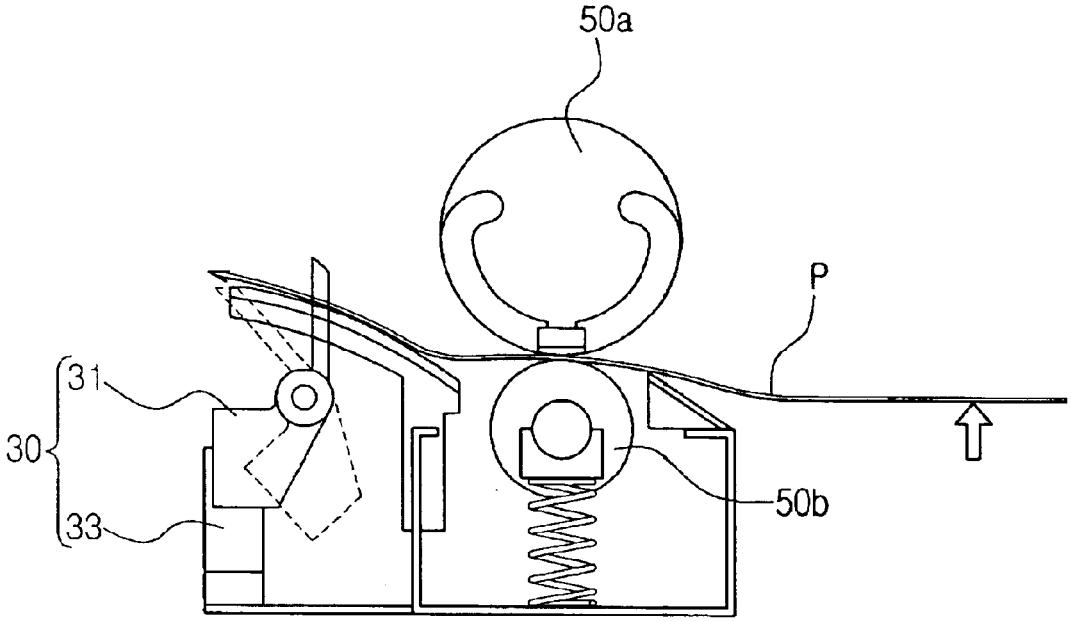
FIG. 2 (PRIOR ART)
FIG. 2 is a view in partial cross section showing an example of a sensor unit used in the image forming apparatus of FIG. 1.
Figure 3:
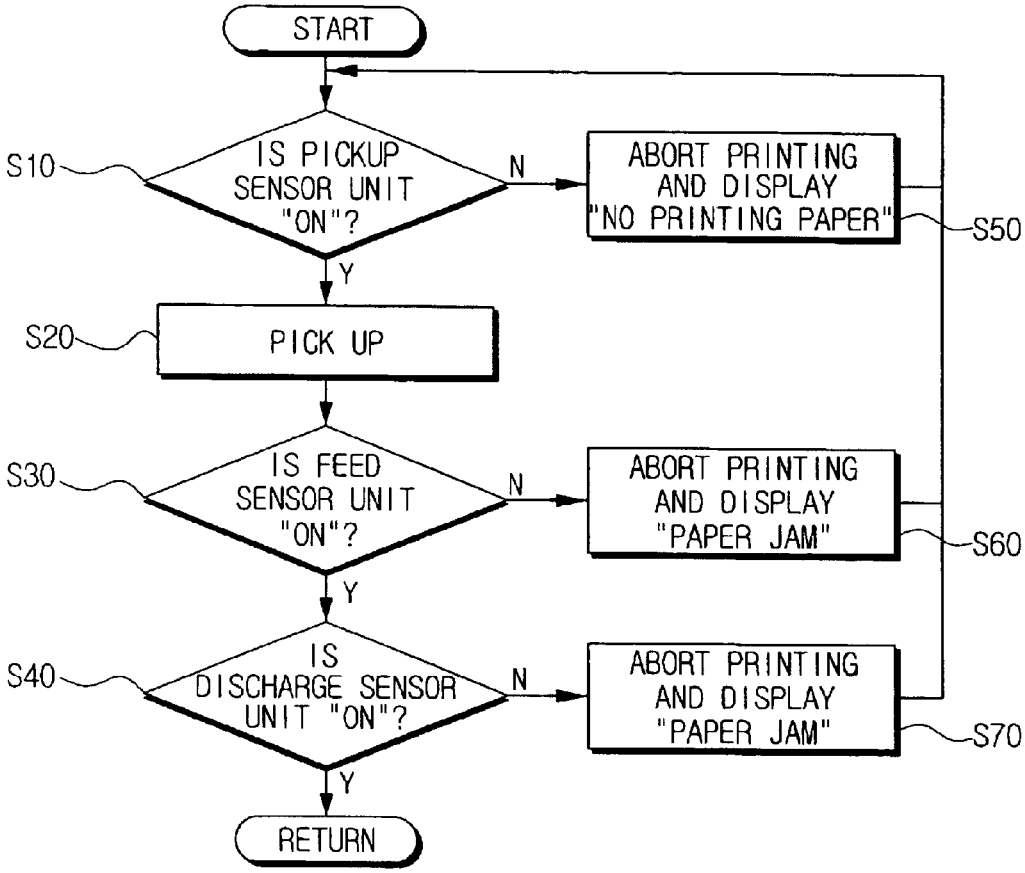
FIG. 3 (PRIOR ART)
FIG. 3 is a flow chart showing a method for judging a paper jam condition of the conventional image forming apparatus of FIG. 1.

The CPU 56 then judges whether a feed sensor unit 20 is in the "ON" or "OFF" state at step S12. When a leading edge of the delivered printing paper passes an actuator of the feed sensor unit 20, the actuator is rotated so that an optical sensor is switched to an "ON" state, in a manner identical to the operation of the actuator/interrupter component shown in FIG. 2, including the actuator 31 and the optical sensor 33 as described above. After a predetermined duration during which the printing paper normally passes the actuator, the optical sensor is switched to the "OFF" state as the rear edge of the paper passes. The timer 57 is then operated, or engaged, by the CPU 56 at the moment the optical sensor is switched to the "ON" state at step S13. After a predetermined time in the normal "ON" state indicating the lead edge has passed, if the feed sensor unit 20 is switched to the "OFF" state indicating the rear edge has passed, the CPU 56 judges that the printing paper is being delivered normally.

However, if after a predetermined time in the "ON" state, if the feed sensor unit 20 does not switch to the "OFF" state, the CPU 56 judges a paper jam condition has occurred, and accordingly aborts the printing operation and notifies the user the paper jam at step S19.

After the printing paper normally passes the feed sensor unit 20, a fixing process is performed on the printing paper, which can include any number of processes as known to those skilled in the art. As the printing paper is delivered to the heating roller 50*a* of the fuser 50, the fuse temperature of the heating roller 50*a* falls as described above. Detecting this, the temperature detecting unit 54 sends a signal to the CPU 56, and the CPU 56 controls the fuse lamp drive unit 52 to switch to the "ON" state so that the fuse lamp 51 can be operated. Hence, the temperature of the heating roller 50*a* is raised to an optimum temperature.

During a $T_{fuser}$ period, a time $T_1$ for the fuser 50 to reach the optimum temperature (i.e. a time during which the fuse lamp drive unit 52 is in the "ON" state), is calculated by checking with the timer 57 at step S14. By comparing $T_1$ with a reference value $T_2$ at step S15, wherein if the $T_1$ is within an error range ±10% of the value $T_2$, and the feed sensor unit 20 is switched to the "OFF" state after a predetermined time at step S16, the CPU 56 judges that the printing paper is normally delivered through the feed sensor unit and fuser, and finally discharges the printing paper at step S17. The period $T_{fuser}$ is a time duration starting from a time when the printing paper engages the feed sensor unit 20 resulting in unit 20 being switched to the "ON" state and then entering the fuser 50, until a time when the feed sensor unit 20 is switched to the "OFF" state and the printing paper is completely discharged from the fuser 50. The value $T_2$ is a time duration for the fuser 50 to remain "ON", and reach an optimum temperature when the printing paper is delivered normally during the $T_{fuser}$ of each environment. That is, the value $T_2$ is an average time for the CPU 56 to control the fuse lamp drive unit 52 of the fuser 50 in the "ON" state.

If the value $T_1$ is out of the error range ±10% of the value $T_2$, the CPU 56 judges a paper jam has occurred, and accordingly aborts the printing operation and notifies the user of the paper jam at step S19. In the above example, the error range can be set to ±10% of $T_2$, however this can be configured considering the fact that range of fuse temperature fluctuations are varied according to a material and attribute of the printing paper. Hence, a time to raise the fuser 50 to an optimum fuse temperature (i.e. a time for the CPU 56 to control the fuse lamp drive unit 52 of the fuser 50 to be in the "ON" state) varies. It will be understood by those skilled in the art that the error range can be changed according to respective test results.

According to the system and method for judging the paper jam described above, the paper jam can be judged without requiring the actuator at the discharging side.

Thereafter, the printing operation is allowed to proceed while the system and method continues judging the paper jam condition continuously by resetting the timer 57.

While the preferred embodiments of the present invention have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A method for judging a paper jam in an image forming apparatus, comprising the steps of:

a) checking a feed sensor unit;

b) operating a timer if it is judged that the feed sensor unit is switched to an "ON" state in the step (a);

c) calculating a value $T_1$ for a fuse lamp drive unit to be in an "ON" state;

d) comparing the value $T_1$ with a reference value $T_2$; and e) judging a paper jam and aborting a printing operation if the value $T_1$ is out of an error range of the value $T_2$ in the comparison of the step (d).

2. The method of claim 1, further comprising the step of:

proceeding with the printing operation if the value $T_1$ is within the error range of the value $T_2$ and the feed sensor unit is switched to an "OFF" state after a predetermined time.

3. The method of claim 1, wherein the error range is defined as a value substantially within ±10% of the value $T_2$.

4. The method of claim 1, further comprising the step of displaying a message indicating the paper jam on a display.

5. The method of claim 1, wherein the value $T_2$ is an average value of a time for the fuse lamp drive unit to be in the "ON" state where the printing paper is delivered to a fuser in a normal condition.

6. A method of judging a paper jam in an image forming apparatus, comprising the steps of:

a) checking a pickup sensor unit;

b) checking a feed sensor unit if it is judged that the pickup sensor unit is in an "ON" state in the step (a);

c) operating a timer if it is judged that the feed sensor unit is switched to an "ON" state in the step (b);

d) calculating a value $T_1$ for a fuse lamp drive unit to be in an "ON" state;

e) comparing the value $T_1$ with a reference value $T_2$; and f) judging a paper jam and aborting a printing operation if the value $T_1$ is out of an error range of the value $T_2$ in the comparison of the step (e).

7. The method of claim 6, further comprising the step of judging a no printing paper condition and aborting the printing operation if the pickup sensor unit is judged to be in an "OFF" state in the step (a).

8. The method of claim 6, further comprising the step of judging the paper jam condition and aborting the printing operation if the feed sensor unit is judged to be in an "OFF" state after a predetermined time in the step (b).

9. The method of claim 6, further comprising the step of:

proceeding with the printing operation if the value $T_1$ is within the error range of the value $T_2$ and if the feed sensor unit is switched to an "OFF" state after a predetermined time.

10. The method of claim 6, wherein the error range is defined as a value substantially within ±10% of value $T_2$.

11. The method of claim 6, further comprising the step of displaying a message indicating the paper jam on a display.

12. The method of claim 6, wherein the value $T_2$ is an average value of a time for the fuse lamp drive unit to be in the "ON" state where the printing paper is delivered to a fuser in a normal condition.

13. A system for detecting a paper delivery abnormality in a device, such as an image forming apparatus, using at least one of a feed sensor unit and fuser temperature controller, the system comprising:

a feed sensor unit, having a sensor and actuator for detecting a leading paper edge and in response switching to an "ON" state, and for detecting a rear paper edge and in response switching to an "OFF" state;

a fuser, having at least one heating element and heating roller to fix an image on a paper surface;

a fuser temperature controller, for maintaining a temperature at said heating roller at a substantially constant predetermined temperature by energizing said heating element;

at least one timer, for monitoring said fuser temperature controller to measure a value $T_1$, wherein said value $T_1$ is a period said heating element is energized; and a controller, for detecting a paper delivery abnormality based upon said feed sensor unit state, value $T_1$ and a reference value $T_2$, wherein said reference value $T_2$ is a reference period said heating element is energized during normal paper delivery.

14. A system for detecting a paper delivery abnormality in a device as claimed in claim 13, wherein said controller detects a paper delivery abnormality when said feed sensor unit switches to an "ON" state, and after a predetermined period does not switch to an "OFF" state.

15. A system for detecting a paper delivery abnormality in a device as claimed in claim 13, wherein said controller detects a paper delivery abnormality when said feed sensor unit switches to an "ON" state, and after a predetermined period switches to an "OFF" state, and the value $T_1$ is greater than or less than the reference value $T_2$.

16. A system for detecting a paper delivery abnormality in a device as claimed in claim 15, wherein said reference value $T_2$ comprises a range including substantially ±10% of said reference period said heating element is energized during normal paper delivery.

17. A system for detecting a paper delivery abnormality in a device as claimed in claim 13, further comprising a pickup sensor unit, having a sensor for detecting a paper stack presence and in response switching to an "ON" state, and wherein said controller detects a paper delivery abnormality when said pickup sensor unit is in an "OFF" state.

18. A method for detecting a paper delivery abnormality in a device, such as an image forming apparatus, using at least one of a feed sensor unit and fuser temperature controller, the method comprising the steps of:

detecting an input paper at a feed sensor unit and monitoring said feed sensor unit to detect a transition between an "OFF" and "ON" state to indicate normal input paper delivery based upon said transition, and detecting a paper delivery abnormality when said normal input paper delivery is not detected;

monitoring a fuser temperature controller and measuring a value $T_1$ wherein said value $T_1$ is a period said fuser temperature controller energizes a heating element to fix an image on said input paper; and comparing said value $T_1$ with a reference value $T_2$, wherein said reference value $T_2$ is a reference period said heating element is energized during normal paper delivery, and detecting a paper delivery abnormality when said normal input paper delivery is detected and said value $T_1$ is greater than or less than the reference value $T_2$.

19. A method for detecting a paper delivery abnormality in a device as claimed in 18, wherein said reference value $T_2$ comprises a range including substantially ±10% of said reference period said heating element is energized during normal paper delivery.

20. A method for detecting a paper delivery abnormality in a device as claimed in claim 18, further comprising the step of:

detecting an input paper at a pickup sensor unit, and detecting a paper delivery abnormality when an input paper is not detected.

* * * * *